United States Patent [19]

Abbott

[11] 3,930,965

[45] Jan. 6, 1976

[54] ZINC-COPPER ALLOY ELECTROPLATING BATHS

[75] Inventor: Charles N. Abbott, Dayton, Ohio

[73] Assignee: McGean Chemical Company, Inc., Cleveland, Ohio

[22] Filed: Mar. 18, 1974

[21] Appl. No.: 452,143

[52] U.S. Cl. ..... 204/44

[51] Int. Cl.[2] ..... C25D 3/58

[58] Field of Search ..... 204/44, 123

[56] References Cited

UNITED STATES PATENTS

| | | | |
|---|---|---|---|
| 2,684,937 | 7/1954 | Westbrook et al. | 204/44 |
| 2,916,423 | 12/1959 | Passal | 204/44 |
| 2,989,448 | 6/1961 | France | 204/44 |

FOREIGN PATENTS OR APPLICATIONS

| | | | |
|---|---|---|---|
| 949,601 | 2/1964 | United Kingdom | 204/44 |
| 949,602 | 2/1964 | United Kingdom | 204/44 |

OTHER PUBLICATIONS

H. P. Coats, Trans. Electrochem. Soc., Vol. 80, pp. 445–457, (1941).

S. Ramachandran et al., Metal Finishing, pp. 64–68, Nov. 1968.

*Primary Examiner*—G. L. Kaplan
*Attorney, Agent, or Firm*—Fay & Sharpe

[57] ABSTRACT

The present invention relates to additives for electroplating baths used for the electrodeposition of zinc-copper alloys, and particularly to such alloys designed to be used as undercoats for subsequently applied metal coatings. The improvement comprises additives for incorporation into conventional zinc-copper electrolytes, comprising a mixture of a buffering agent selected from the group consisting of boric acid, alkali metal borates, alkali metal carbonates, alkali metal phosphates and glycine, a metal ion selected from the group consisting of nickel ion and cobalt ion, and ethylenediaminetetra acetic acid (as the alkali metal salt).

8 Claims, No Drawings

ZINC-COPPER ALLOY ELECTROPLATING BATHS

The present invention relates to the electrodeposition of zinc-copper alloys. More particularly, it relates to additives for use in electroplating baths used for the electrodeposition of zinc-copper alloys.

Electrodeposited zinc-copper alloys are useful for numerous purposes, one particularly important use being as an undercoat on which other metals are likewise applied by electrodeposition. When used for such purpose it is particularly important that the electrodeposited coating of zinc-copper alloy be smooth, fine-grained, reflective and uniform in appearance as well in other physical properties even when applied over a wide current density range. If otherwise, the metal coating applied over the zinc-copper alloy will generally be defective and it may be necessary either to discard or else rework the coated article. This is particularly the case where the zinc-copper alloy coating is coarse grained, since the latter will generally show through the subsequent coating. Many efforts have been made to overcome such defects of previous zinc-copper electroplating processes but without too much success.

It has now been discovered in accordance with the present invention that by incorporating certain additives into the conventional zinc-copper electroplating baths, comprising essentially zinc cyanide, copper cyanide, alkali metal cyanide and alkali metal hydroxide, that zinc-copper alloys can be formed by electrodeposition having the above desired properties under operating conditions requiring less supervision and with fewer rejects than has been the case with prior art methods. The additive composition which gives such improved results comprises essentially a mixture of a buffering agent effective in the electroplating bath within the 10 – 13 pH range and selected from the group consisting of boric acid, alkali metal borates, alkali metal phosphates, alkali metal carbonates and glycine; nickel or cobalt ion, preferably in the form of the metal complex; and a soluble salt of ethylenediaminetetra acetic acid, the latter appearing to serve both as a brightening agent and as a complexing agent for the nickel or cobalt.

The plating baths in which the above additive composition has been found to be particularly effective have the following general composition:

| | | |
|---|---|---|
| Zinc cyanide | 13.5 – 40.4 | gm/l |
| Copper cyanide | 10.6 – 31.7 | " |
| Sodium cyanide (free) | 30.0 – 52.5 | " |
| Sodium hydroxide | 15.0 – 45.0 | " |

The above bath gives a zinc-copper alloy upon electrodeposition having the composition: 70 – 30% zinc to 30 – 70% copper. A preferred composition for subsequent electrodeposition of metal has been found to be of the order of 50 – 45% zinc to 50 – 55% copper.

The additive composition of the present invention used in the above plating bath has the following preferred composition:

| | | |
|---|---|---|
| Boric acid, or alkali metal borate | 0.010 – 40.0 | gm/l |
| Nickel or cobalt metal (in form of nickel or cobalt complex) | 0.001 – 0.025 | " |

For the boric acid or alkali metal borate it has been found that the following can be substituted:

| | | |
|---|---|---|
| Alkali metal phosphate | 0.1 – 20.0 | gm/l |
| Glycine | 1.0 – 15.0 | " |
| Alkali metal carbonate | 1.0 – 75.0 | " |

It has further been found that the above additive may be improved somewhat by incorporating in the above additive composition 0.01 – 2.0 gm/l of ethylenediaminetetra acetic acid (preferably in the form of its alkali metal salt), which acts both as a brightening agent and as a complexing agent for the nickel or cobalt.

The following specific examples are given to illustrate the effect of the individual ingredients of the additive composition of the present invention, as well as how the ingredients of the plating bath may be varied and still obtain the improved results of the instant invention. It is understood also that the composition of the plating bath may be varied in any conventional manner without departing from the scope of the present invention so long as the plating conditions are maintained substantially as described herein.

In each of the first eleven examples the Hull Cell was used, employing an alloy anode containing 52% zinc and 48% copper, and mild air agitation of the anode during the plating operation. Zinc-coated 3 × 5 inches steel plates were processed through the following cycle, the plating temperature being maintained at 72° – 80°F:

1. 50% HCl strip - 1 minute
2. Rinse
3. Electro-clean (reverse) - 1 minute
4. Acid dip (10% sulfuric)
5. Rinse
6. Copper strike
7. Rinse
8. Brass plate
9. Rinse
10. Hot water rinse
11. Dry
12. Evaluate

EXAMPLE I

| | | |
|---|---|---|
| Zinc cyanide | 25.5 | gm/l |
| Copper cyanide | 22.5 | " |
| Sodium cyanide | 64.5 | " |
| Sodium hydroxide | 33.8 | " |
| Additive | None | |

The resulting deposit was dull to semi-bright at current densities of 5 – 100 amperes/ft$^2$ and was regarded as unsatisfactory for subsequent plating.

EXAMPLE II

| | | |
|---|---|---|
| Zinc cyanide | 25.5 | gm/l |
| Copper cyanide | 22.5 | " |
| Sodium cyanide | 64.5 | " |
| Sodium hydroxide | 33.8 | " |
| Additive: | | |
| Boric acid | 15.0 | " |

The resulting deposit was semi-bright and reflective at current densities of 5 – 70 amperes/ft$^2$ and showed a decided improvement over the use of no additive but still was not satisfactory for subsequent plating.

EXAMPLE III

| | | |
|---|---|---|
| Zinc cyanide | 25.5 | gm/l |